US005980441A

United States Patent [19]

Kolbe et al.

[11] Patent Number: 5,980,441

[45] Date of Patent: Nov. 9, 1999

[54] METHOD AND APPARATUS FOR PRODUCING BAGS WITH CARRYING HANDLES BY USING A FEEDBACK TENSION CONTROL LOOP

[75] Inventors: Wilfried Kolbe, Gülzow; Klaus Schirrich, Bielefeld; Dieter Obermeier, Bad Salzuflen; Fred Rostalski, Bielefeld, all of Germany

[73] Assignee: Fischer & Krecke GmbH & Co., Bielefeld, Germany

[21] Appl. No.: 08/893,905

[22] Filed: Jul. 11, 1997

[30] Foreign Application Priority Data

Sep. 19, 1996 [EP] European Pat. Off. ..... 96115023

[51] Int. Cl.[6] ..... B31B 1/86

[52] U.S. Cl. ..... 493/226; 493/926; 53/134.1; 53/202

[58] Field of Search ..... 493/226, 926; 53/134.1, 202

[56] References Cited

U.S. PATENT DOCUMENTS

| | | | |
|---|---|---|---|
| 2,248,895 | 6/1941 | Parrish | 493/226 |
| 3,034,409 | 5/1962 | Finke et al. | 493/226 |
| 3,334,550 | 8/1967 | Craig | 439/226 |
| 3,439,591 | 4/1969 | Class et al. | 493/35 |
| 3,481,256 | 12/1969 | Hayes | 493/226 |
| 3,548,723 | 12/1970 | Sengewald | 493/226 |
| 3,613,523 | 10/1971 | Wesselmann | 493/226 |
| 3,865,018 | 2/1975 | Gaffney | 493/226 |
| 3,879,246 | 4/1975 | Walker | 156/265 |
| 3,967,544 | 7/1976 | Brock et al. | 493/197 |
| 4,216,705 | 8/1980 | Achelpohl et al. | 493/33 |
| 4,906,319 | 3/1990 | Fiorani | 53/134.1 |
| 5,194,062 | 3/1993 | Membrino | 493/203 |
| 5,298,007 | 3/1994 | Achelpohl et al. | 493/226 |
| 5,350,350 | 9/1994 | Maccalli | 493/226 |
| 5,409,441 | 4/1995 | Muscoplat | 493/223 |
| 5,421,805 | 6/1995 | Baxter et al. | 493/226 |
| 5,609,556 | 3/1997 | Rostalski et al. | 493/226 |
| 5,816,993 | 10/1998 | Fowler et al. | 493/226 |

FOREIGN PATENT DOCUMENTS

| | | |
|---|---|---|
| 2446007 | 4/1975 | Germany . |
| 9414380 | 2/1996 | Germany . |
| WO9310968 | 6/1993 | WIPO . |

*Primary Examiner*—Peter Vo
*Assistant Examiner*—Eric J. Weierstall
*Attorney, Agent, or Firm*—Richard M. Goldberg

[57] ABSTRACT

A method for producing bags (12) with carrying handles (48), for which the starting material for the carrying handles is supplied as endless material and at least two carrying handles are affixed to each finished or still unfinished bag, in which the starting material for the several carrying handles (48) belonging to one bag (12), to begin with, are supplied in the form of a single strip (20) of material, which then is divided up continuously into several parallel partial strips (38, 40) for the individual carrying handles.

4 Claims, 1 Drawing Sheet

METHOD AND APPARATUS FOR PRODUCING BAGS WITH CARRYING HANDLES BY USING A FEEDBACK TENSION CONTROL LOOP

BACKGROUND OF THE INVENTION

The invention relates to a method and an apparatus for producing bags with carrying handles.

SUMMARY OF THE INVENTION

Bags of paper or plastic, which are used, for example, in the retail trade as carrying bags, usually are provided with two carrying handles, which are affixed to opposite walls of the bag. The carrying handles generally consist of several layers of Methods and apparatuses for producing the bags are known as such in various forms. For example, in U.S. Pat. No. 3,439,591, a method is described, for which the bag is produced from an endless tube, which is divided into sections of suitable length. A bag with a closed bottom is formed from each section by folding and gluing one end.

Examples of apparatuses for producing and affixing carrying handles are described in U.S. Pat. Nos. 3,613,523 and 5,298,007 and DE-U-94 14 380. The carrying handles are attached either to the finished bags or to the endless starting material before or after this is closed to a tube even before the bag is produced. The handle-affixing apparatuses generally are disposed symmetrically above and below the transporting path for the bags, so that the carrying handles can be affixed to the bags from opposite sides. Until now, an unrolling device, with which the starting material for the carrying handle in question can be pulled off from a roll in the form of an endless strip, is assigned to each handle-affixing apparatus. The width of this strip depends on the width of the desired carrying handle and on the number of layers of material of this carrying handle and typically is of the order of about 8 cm. The roll from which this strip is pulled, has a relatively large initial diameter, for example, of the order of 1 m, so that excessively frequent stoppages of the operation for changing rolls are avoided. Because of the unfavorable relationship between the width and the diameter of the roll, the latter is relatively unstable and therefore difficult to handle.

It is an object of the invention to provide a method for producing bags with carrying handles, which permits the starting material for the carrying handles to be handled simply and reliably.

Pursuant to the invention, this objective is accomplished by the method given in claim 1. An appropriate apparatus for carrying out the method is the object of the independent claim 3.

Pursuant to the invention, the starting material for the several carrying handles belonging to one bag are initially supplied in the form of a single strip of material, which is then divided continuously into several, parallel partial strips for the individual carrying handles.

Since at least two carrying handles are affixed to each bag, the width of the roll, from which the material is pulled during the inventive method, is at least twice as large as it is in the case of the state of the art, so that, for a roll of the same diameter, a significantly higher stability is attained and, with that, a significantly simpler handling becomes possible.

Furthermore, an appreciable simplification of the apparatus becomes possible as a result of the inventive method, since only a single unrolling device is required for the starting material for all carrying handles. If the starting material for the carrying handles is used up, the starting material for all handle-affixing devices is replenished once again by only a single exchange of rolls. By these means, not only is possible to shorten the duration of the interruption to the operation required for the exchange of rolls, but the number of interruptions to the operation is also reduced because, in differentiation from the state of the art, it is ensured by the inventive method that the material for the several handle-affixing devices is always used up at exactly the same time.

Advantageous refinements and further developments of the invention are within the scope of the claims.

By means of the distinguishing features, it is ensured with particularly simple means that the strip of starting material and the partial strips formed therefrom always have the correct tension and that the partial strips of the whole of the installation are supplied synchronously with the speed required by the working cycle of the plant as a whole.

BRIEF DESCRIPTION OF THE DRAWINGS

In the following, a preferred embodiment of the invention is explained in greater detail by means of the drawing, in which.

DESCRIPTION OF THE PREFERRED EMBODIMENTS

Figure 1:
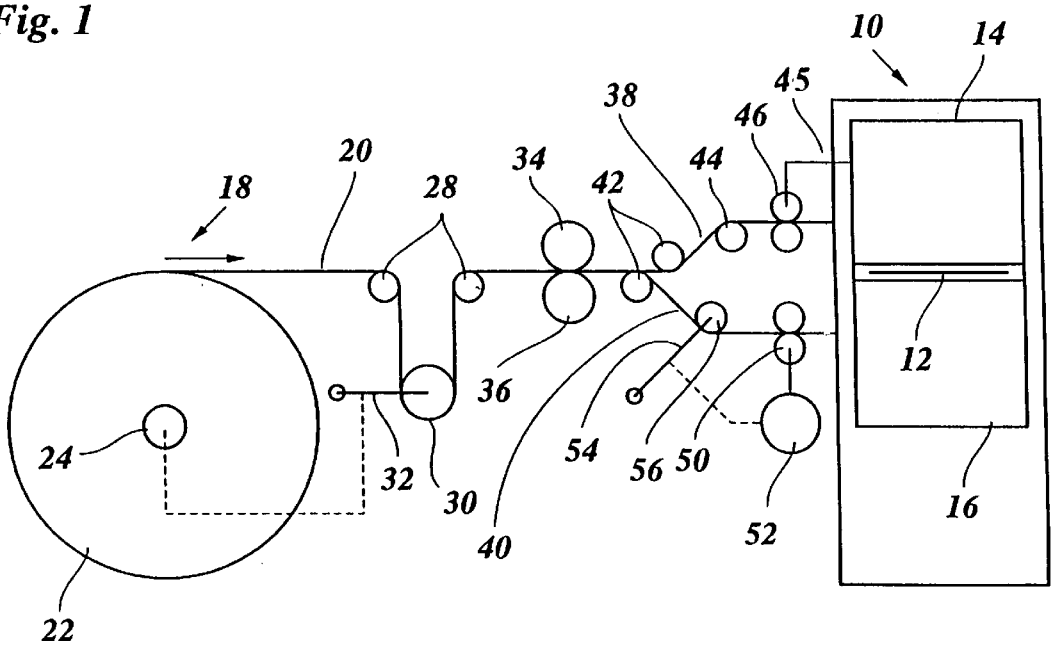
FIG. 1 shows a diagrammatic side view of an apparatus for supplying the starting material for the carrying handles and FIG. 2 shows the apparatus of FIG. 1 in plan view.

Of the plant for producing bags with carrying handles, only a handle-affixing station 10 is shown in FIG. 1. The bags 12 pass through this station 10 in the direction perpendicular to the plane of the drawing. In the example shown, it is assumed for the sake of simplicity that the carrying handles are to be affixed to the bags 12, which in other respects are already finished. Alternatively, it is, however, also possible to affix the carrying handles to the tubular starting material for the bags before the individual bags 12 are produced from this material.

The handle-affixing station 10 has an upper handle-affixing device 14 and a lower handle-affixing device 16, which is constructed in mirror image fashion to the device 14. The handle-affixing devices are shown here only as a blocks, since their construction, as such, is known.

A common unrolling unit 18, in which a strip 20 of starting material (such as a paper strip) is pulled from a roll 22, is assigned to the two handle-affixing devices 14 and 16. In the example shown, the strip 20 of starting material has a width of about 16 cm. The roll 22 has an initial diameter of, for example 1 m and is slipped non-rotatably on a spindle 24, which is mounted so that it can be braked and alternately also driven in a drive mechanism housing 26 (FIG. 2).

A dancer system with deflection rollers 28 and a dancer roller 30 acts over a controller 32 on the brake of the spindle 24, so that the tension on the strip 20 of starting material is controlled, for example, at 100 N.

A longitudinal cutting device with a knife roller 34 and a counter-knife roller 36 divides the strip 20 of starting material along its center line into two parallel, partial strips 38, 40, which are deflected upwards or downwards at the deflection roller 42. The upper partial strip 38 runs over a further deflection roller 44 to a web traction mechanism 46, which is formed by two clamping rollers and the driving mechanism of which is coupled directly to the upper handle-affixing device 14, so that the partial strip 38 can be supplied as required. The drawing-in speed for partial strip 38 is controlled by web traction mechanism 46, in accordance with the operating speed of handle-affixing device 14, through a line 45. In the upper handle-affixing device 14, the partial strip 38 is then processed further into a U-shaped, folded carrying handle 48, which is glued to the upper side of each bag 12, as can be seen in FIG. 2.

Figure 2:
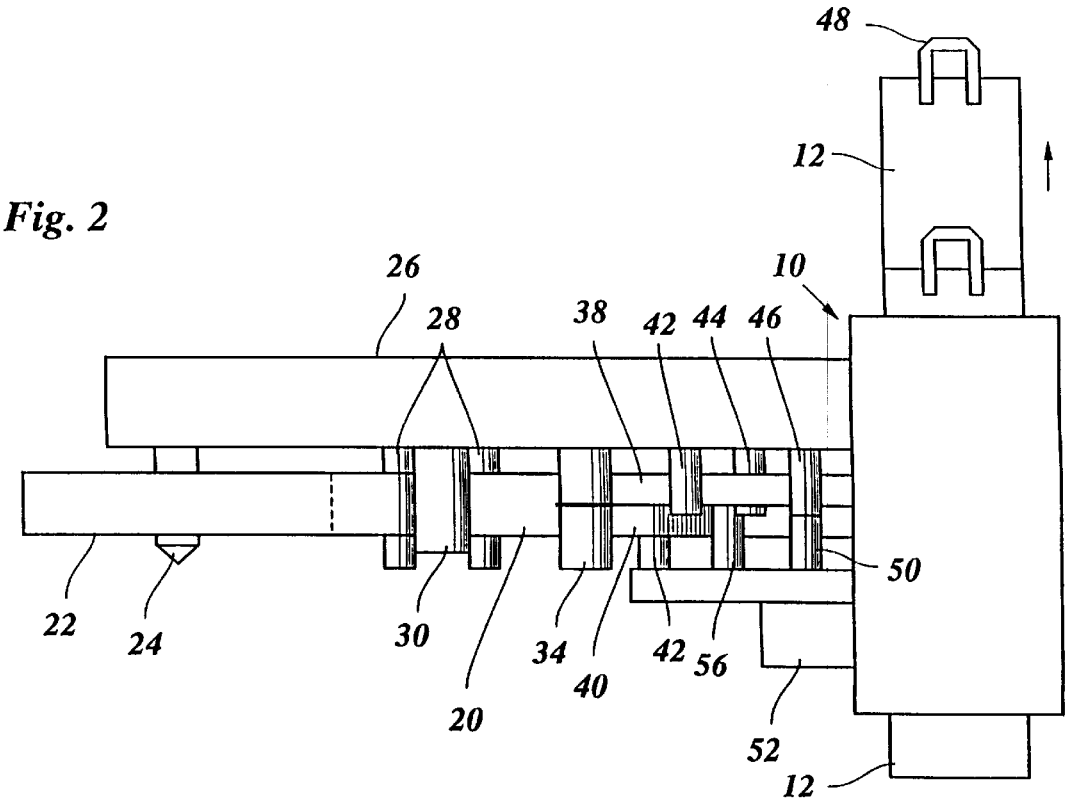

The lower partial strip 40 is processed in the lower handle-affixing apparatus 16 in a similar manner into carrying handles, which are affixed to the lower wall of each bag 12, which cannot be recognized in FIG. 2. The two handle-affixing devices 14 and 16 work synchronously.

For the lower partial strip 40, however, a web traction mechanism 50 is provided, which is driven independently of the lower handle-affixing device 16 by a motor 52. The speed of the motor 52 is controlled by a controller 54 which, with the help of a measuring roller 56, probes the tension on the lower partial strip 40. The tension on the partial strip 40 is controlled at a constant value (50 N in the example described) in this manner, which corresponds exactly to half the tension on the initial strip 20 of material.

The difference between the tension on the initial strip 20 of material and the tension on the partial strip 40 is the tension on the other partial strip 38. The control system described thus ensures that the two partial strips 38 and 40 always have the same tension and that there is therefore no distortion in the strip of starting material before the longitudinal cutting device 34, 36. Since both partial strips 38, 40 thus also have the same speed, the lower partial strip 40 is also supplied to the lower handle-affixing device 16 as required in such a way that slight structural differences between the two handle-affixing devices 14, 16 do not lead to an accumulation of tension differences, The example described above can be modified in various ways. For example, it is possible to divide the initial strip 20 of material into more than two partial strips, if more than two carrying handles are to be affixed to one bag or if each carrying handle consists of several separate strips. In this case, the web traction mechanism for a partial strip is coupled to the corresponding handle-affixing device and the web traction devices for the other partial strips are controlled, as described above for the partial strip 40. At the same time, the ratio of tensions depends on the number of partial strips 40 and, in the event that the partial strips have different widths, also on the width ratio.

We claim:

1. An apparatus for producing bags with carrying handles, comprising:

at least two synchronously operating handle-affixing devices, a common unrolling unit for holding a roll having a strip of starting material to be pulled off from the roll, and assigned to the handle-affixing devices, a longitudinal cutting unit following the unrolling unit, and which divides the strip of starting material into at least two parallel partial strips, each of which is supplied to one of the handle-affixing devices, a device for controlling the tension of the strip of starting material positioned between the common unrolling unit and the longitudinal cutting device, a driving mechanism of a web traction mechanism for supplying one partial strip to one of the handle-affixing devices, the driving mechanism being coupled directly to said one handle-affixing device, a tension detecting device for detecting tension on at least another partial strip, and at least one web traction device including a motor for supplying said at least another partial strip to the handle-affixing devices at a speed which depends on tension of the respective partial strip.

2. The apparatus of claim 1, further comprising a spindle carrying the roll, and wherein the device for controlling the tension of the strip of starting material includes a brake for the spindle carrying the roll in order to control the tension of the strip of starting material.

3. The apparatus of claim 1, further comprising a spindle carrying the roll, and wherein the device for controlling the tension of the strip of starting material includes a driving mechanism for the spindle carrying the roll in order to control the tension of the strip of starting material.

4. A method for producing bags with carring handles, comprising the steps of:

supplying a starting material for the carrying handles from a roll of endless material in the form of a single strip, dividing the single strip continuously into at least two parallel partial strips for producing at least two individual carrying handles, detecting the tension of the strip of starting material, controlling the tension of the strip of starting material between the supplying roll and the point of division, driving a web traction mechanism for supplying at least one of the at least two parallel partial strips to an attached handle affixing device with at an operating speed determined from said device, detecting the tension in at least one other of the at least two parallel partial strips which is being supplied to another handle affixing device, controlling the tension of the at least one other of the at least two parallel partial strips at a value which is at a specified ratio to the tension of the strip of starting material, and affixing said at least two carrying handles to each finished or unfinished bag.

* * * * *